US007026907B2

(12) United States Patent
Takeda

(10) Patent No.: US 7,026,907 B2
(45) Date of Patent: Apr. 11, 2006

(54) THERMAL PROTECTOR

(75) Inventor: Hideaki Takeda, Saitama (JP)

(73) Assignee: Uchiya Thermostat Co., Ltd., Saitama-Ken (JP)

( * ) Notice: Subject to any disclaimer, the term of this patent is extended or adjusted under 35 U.S.C. 154(b) by 14 days.

(21) Appl. No.: 10/469,715

(22) PCT Filed: Feb. 28, 2002

(86) PCT No.: PCT/JP02/01878

§ 371 (c)(1),
(2), (4) Date: Sep. 2, 2003

(87) PCT Pub. No.: WO02/071431

PCT Pub. Date: Sep. 12, 2002

(65) Prior Publication Data

US 2004/0075526 A1 Apr. 22, 2004

(30) Foreign Application Priority Data

Mar. 2, 2001 (JP) ..... 2001-059063

(51) Int. Cl.
*H01H 37/52* (2006.01)

(52) U.S. Cl. ..... 337/85; 337/100

(58) Field of Classification Search ..... 337/36, 337/85, 86, 97, 110, 112, 113, 333, 362, 363, 337/372, 380, 381
See application file for complete search history.

(56) References Cited

U.S. PATENT DOCUMENTS

| | | | | |
|---|---|---|---|---|
| 2,249,837 | A | 7/1941 | Lee | |
| 3,240,908 | A | 3/1966 | Marcoux | |
| 5,607,610 | A * | 3/1997 | Furukawa | 219/505 |
| 5,757,262 | A | 5/1998 | Takeda | |
| 5,796,327 | A | 8/1998 | Smith | 337/342 |
| 5,847,637 | A * | 12/1998 | Takeda et al. | 337/344 |
| 6,281,780 | B1 * | 8/2001 | Sugiyama et al. | 337/137 |
| 6,498,559 | B1 * | 12/2002 | Cornell et al. | 337/53 |
| 6,559,752 | B1 * | 5/2003 | Sienkiewicz et al. | 337/53 |
| 6,577,223 | B1 * | 6/2003 | Takeda | 337/377 |
| 6,633,222 | B1 * | 10/2003 | Nagai et al. | 337/365 |

FOREIGN PATENT DOCUMENTS

| | | |
|---|---|---|
| GB | 2 280 785 | 2/1995 |
| JP | 41-20515 | 6/1966 |
| JP | 58-71307 | 11/1981 |
| JP | 6-251674 | 9/1994 |
| JP | 9-501259 | 2/1997 |
| JP | 9-120763 | 5/1997 |
| WO | WO 95/04364 | 2/1995 |

* cited by examiner

*Primary Examiner*—Anatoly Vortman
(74) *Attorney, Agent, or Firm*—Greer, Burns & Crain, LTD

(57) ABSTRACT

A thermal protector includes a partition wall which encloses an arrangement portion of a movable contact and a fixed contact from three sides. The partition wall is adjacent the contacts in a range that does not inhibit the opening/closing operations of the contacts, and is formed to be higher than the fixed contact and a gap between the contacts, but not exceed the height of a movable plate to which the movable contact is attached, when the contacts are released.

5 Claims, 4 Drawing Sheets

THERMAL PROTECTOR

TECHNICAL FIELD

The present invention relates to a thermal protector used to prevent the overheating of a hot-air generating device of a hair dryer, an electronic fan heater, a popcorn machine, etc.

BACKGROUND ART

Conventionally, a thermal protector like that shown in FIG. 4 exists. In the thermal protector 1 shown in this figure, external circuit connection terminals 3 and 4 are respectively secured to both ends of a lower portion of a securing portion 2 made of an insulating synthetic resin. The ends of the external circuit connection terminals 3 and 4, which are secured to the securing portion 2, are incorporated into one body with the securing portion 2 in a form of being folded within the securing portion and respectively exposed at both ends of an upper portion of the securing portion 2, although this is not clearly shown in the figure.

To an upper exposed portion 5 of the external circuit connection terminal 3, one end 6-1 of a movable plate 6 is secured, for example, with spot welding. At the other end 6-2 of the movable plate 6, a movable contact 7, which protrudes over the lower surface, is arranged by caulking the upper surface. In the central portion of the movable plate 6, a bimetal 11 whose breadth direction is aligned by drop preventing pieces 8*a* and 8*b*, which are arranged to be erect at both sides, and whose both ends in the vertical direction are engaged in two engagement pieces 9*a* and 9*b*, which are formed to be hooked and as opposed to each other, to engage with the movable plate 6 is arranged. Additionally, on an upper exposed portion 12 of the external circuit connection terminal 4, a fixed contact 13 is arranged by being caulked. The movable contact 7 and the fixed contact 13 are arranged in positions which correspond to each other.

In this thermal protector 1, the bimetal 11 warps in a convex state in an upward direction at a temperature equal to or lower than a preset temperature, and the movable contact 7, which is supported by the other end 6-2, of the movable plate 6 made of an elastic body is pressed against the fixed contact 13 by its elasticity, so that the contacts are closed.

This thermal protector 1 is used as a temperature over-rise preventing device arranged on a flow path of hot air so as to prevent the overheating of a hot-air generating device arranged, for example, in a hair dryer, an electronic fan heater, a popcorn machine, etc. The bimetal responds to the hot air of an extra-high temperature, and the warpage in the convex state in the upward direction until at that time is inverted to the concave state in the upward direction, whereby the contacts are released, an electric current to the hot-air generating device is interrupted, and the overheating is prevented.

Conventionally, such a thermal protector is used by leaving the periphery of the contacts that open/close a power supply open as shown in FIG. 4. A member shaped like a partition wall that is arranged in the neighborhood of the movable contact 7 in some thermal protectors. However, the partition wall is arranged by necessity from an assembly viewpoint. If there is no necessity from an assembly viewpoint, the concept that the periphery of the contacts is shielded from an outside does not conventionally exist if there is no necessity from an assembly viewpoint.

A hair dryer is taken as an example. The number of recent hair dryers, which have a large capacity to emit a high volume of air (wind velocity) with high heat in order to enhance the performance as a dryer, has been growing. For such a large-capacity hair dryer that emits a high volume of air with high heat, the size of its heater must be enlarged with an increase in the size of its fan. Accordingly, the number of hair dryers where a high electric current over 10A flows in use has been becoming large.

Generally, the higher a flowing electric current or a voltage between contacts, the more an arc occurs between the contacts released when the electric current is interrupted. As described above, also in the case where an electric current as high as 10A flows at a high voltage of 100V, an arc occurs between the contacts when the electric current is interrupted. In the case of the above described large-capacity hair dryer, the energizing and the interrupt of a power supply for the heater are performed in a relatively frequent manner during its use.

The thermal protector as the above described conventional technique has one problem. Namely, as described above, a time period during which an arc that occurs between contacts when a power supply is interrupted discharges between the contacts is an instant from a macroscopic viewpoint, and an arc instantaneously occurs and disappears without being carried away by a wind even in hot air having a high rate of flow in normal cases. However, if the wind velocity exceeds a limit, an arc comes out of the contacts and is spattered to a peripheral conductive member in many cases.

Normally, the temperature of an arc is as high as several thousand degrees centigrade. Therefore, a phenomenon that if an arc between contacts is spattered to a conductive member other than the contacts even for a moment, the portion of the conductive member is extraordinarily heated and melted has been proved to occur from a microscopic viewpoint.

If a conductive member in the periphery of contacts is repeatedly melted, this causes diverse problems such as hastening the wear-out of the conductive member, causing a short circuit, or the like.

An object of the present invention is to provide a thermal protector that properly completes the interrupt of an electric current without damaging a peripheral member by an arc between contacts, which comes out of the contacts by being carried away by a wind velocity, even if a high electric current is interrupted in a large volume of air, in view of the above conventional circumstances.

DISCLOSURE OF INVENTION

In a preferred embodiment according to the present invention, a thermal protector, which opens/closes an electric circuit with a bimetal inverting a warpage direction by using a set temperature as a boundary, is configured by comprising: a fixed contact connected to one of external circuit connection terminals; a movable contact that is connected to the other of the external circuit connection terminals and arranged in a position corresponding to the fixed contact; and a partition wall that encloses an arrangement portion of the fixed contact and the movable contact from three sides, is adjacent to the fixed contact and the movable contact in a range which does not inhibit contact operations of the fixed contact and the movable contact, and is formed to be higher than at least the height of the fixed contact.

In the preferred embodiment, this thermal protector is configured in such a way that the movable contact is arranged at one end of a movable plate, which engages with the bimetal, the other end of the movable plate is secured and connected to the other of the external circuit connection terminals, and at least a partition wall in a central portion among the three sides of the partition wall is higher than a contact gap between the fixed contact and the movable contact when the contacts are released, and has a height which does not exceed the height of the one end of the movable plate when the contacts are released.

Additionally, in the preferred embodiment, the partition wall has a height which exceeds at least the fixed contact, and is arranged to enclose the movable plate.

Furthermore, the partition wall is made of an insulating material. In another preferred embodiment, the partition wall is incorporated into one body with the one and the other of the external circuit connection terminals.

As described above, according to the present invention, a problem that a conductive member in the periphery of contacts is extraordinarily heated and melted by a spattering arc, which hastens damage or causes a short circuit is solved. As a result, the reliability of an appliance is improved. Furthermore, the thermal protector is configured to make it difficult that a wind directly flows between the contacts in any direction, whereby restrictions on an arrangement position of the thermal protector are eliminated, which enhances the degree of freedom of designing an appliance where the thermal protector is arranged inside, and offers a convenience.

BRIEF DESCRIPTION OF DRAWINGS

FIG. 1(*b*) is a sectional side view showing the configuration of contacts closed at a normal temperature;

FIG. 1(*c*) is a sectional side view showing the state where the contacts are open at a high temperature;

FIG. 1(*d*) is a perspective view showing an entire configuration;

BEST MODE OF CARRYING OUT THE INVENTION

Figure 1:
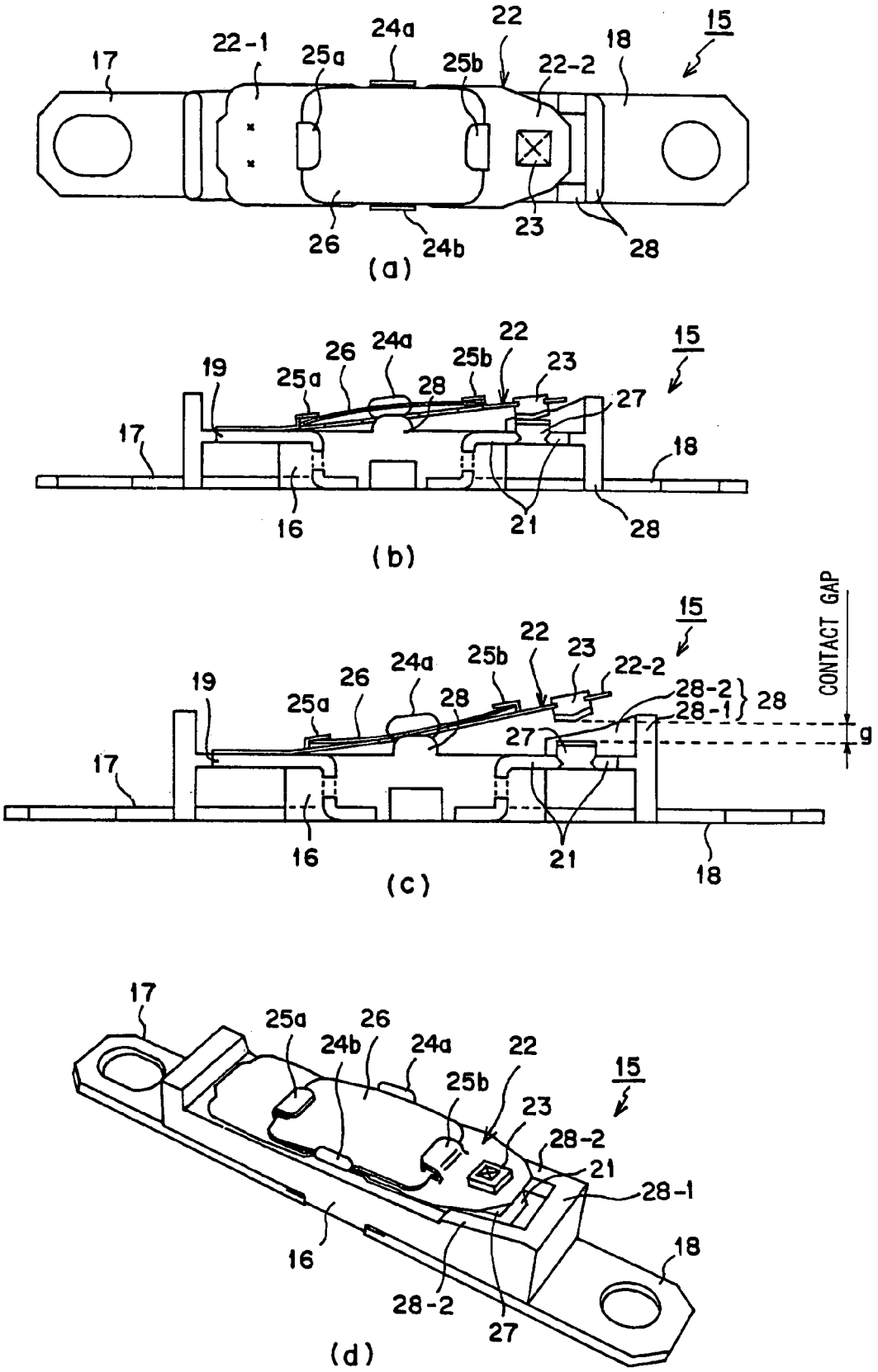
FIG. 1(*a*) is a plan view of a thermal protector according to a first preferred embodiment.

FIG. 1(*a*) is a plan view of a thermal protector according to the first preferred embodiment, FIG. 1(*b*) is a sectional side view showing the configuration where contacts are closed at a normal temperature, FIG. 1(*c*) is a sectional side view showing the state where the contacts are open when the thermal protector operates at a high temperature, and FIG. 1(*d*) is a perspective view showing an entire configuration.

Figure 4:
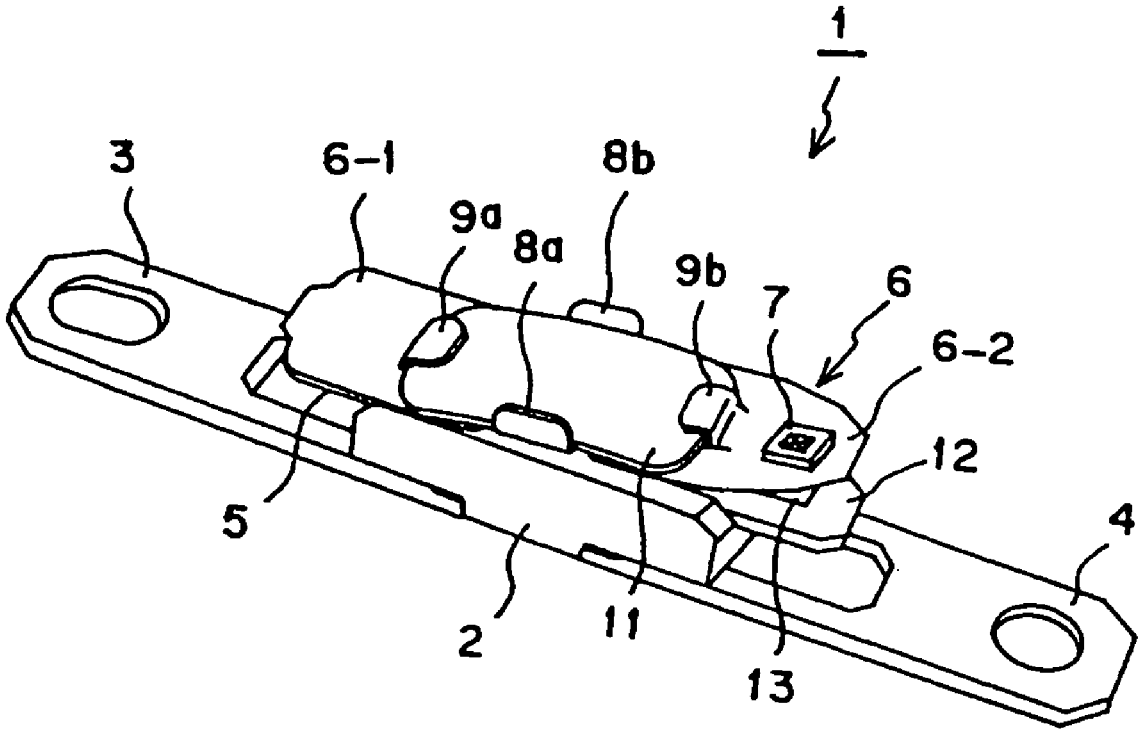
F I G. 4 (PRIOR ART)
FIG. 4 shows an example of a conventional thermal protector.

In the thermal protector 15 shown in FIGS. 1(*a*) to 1(*d*), configurations of a securing portion 16 made of an insulating synthetic resin, metal external circuit connection terminals 17 and 18, their upper exposed portions 19 and 21, a metal movable plate 22, one end 22-1 of the metal movable plate 22, the other end 22-2 of the metal movable plate 22, a movable contact 23, drop preventing pieces 24*a* and 24*b*, engagement pieces 25*a* and 25*b*, a bimetal 26, and a fixed contact 27 are similar to those of the securing portion 2, the external circuit connection terminals 3 and 4, the upper exposed portions 5 and 12, the movable plate 6, one end 6-1 of the movable plate 6, the other end 6-2 of the movable plate 6, the movable contact 7, the drop preventing pieces 8*a* and 8*b*, the engagement pieces 9*a* and 9*b*, the bimetal 11, and the fixed contact 13 of the conventional thermal protector 1 shown in FIG. 4.

As shown in FIGS. 1(*b*) and 1(*c*), a column support 28 which protrudes upward is formed in the center of the upper surface of the securing portion 16. The tip of the column support 28 takes the shape of a hemisphere, a pyramid, a cone, etc., or has point or line contact to abut against the lower surface of the movable plate 26.

If the bimetal 26 warps from a normal convex state in the upper direction, which is shown in FIG. 1(*b*), to a concave state in the upper direction, which is shown in FIG. 1(*c*), due to a thermal response in hot air which exceeds the boundary of a set temperature, the movable plate 22 is deformed, so that the movable contact 23 and the fixed contact 27 rapidly draw apart, and the contacts are opened (released). Naturally, if the heat generation of a heater stops due to the interrupt of an electric current, and the temperature drops to the boundary of the set temperature or lower, the warpage is again inverted, and the bimetal 26 restores to the state shown in FIG. 1(*b*). Here, a gap g between the heights of the movable contact 23 and the fixed contact 27, which is shown in FIG. 1(*c*), is an open contact gap when an electric current is interrupted.

In this configuration, a difference from the case shown in FIG. 4 exists in a point that a partition wall 28 (28-1 and 28-2) which encloses the arrangement portion of the movable contact 23 and the fixed contact 27 from three sides is arranged in this example. This partition wall 28 is formed as adjacent to the fixed contact 27 and the movable contact 23 as possible (namely, adjacent to the upper exposed portion 21 of the external circuit connection terminal 18, and the other end 22-2 of the movable plate 22) in a range which does not inhibit the opening/closing contact operations of the fixed contact 27 and the movable contact 28.

Additionally, this partition wall 28 is formed to be higher than at least the height of the fixed contact 27 as shown in FIG. 1(*c*). Namely, also relatively low partition walls 28-2 on two sides among the three sides are formed to be higher than the height of the fixed contact 27.

Furthermore, at least a partition wall 28-1 in the central portion of the three sides of the partition wall 28 is configured to be higher than the contact gap g, which is shown in FIG. 1(*c*), between the fixed contact 27 and the movable contact 23 when the contacts are released, and to have a height which does not exceed the height of the other end 22-2 of the movable plate 22 when the contacts are released.

In this way, in the thermal protector according to this preferred embodiment, it becomes difficult that a wind directly flows between the contacts even at a wind velocity which exceeds a limit in the case of a conventional thermal protector. Therefore, even if an arc which discharges between the contacts the moment when a high electric current is interrupted becomes larger than a normal value, or even if a wind velocity at that time is high, the arc does not come out of the contacts by being carried by the wind and is not spattered to a peripheral conductive member, or the arc is very slight if it exists. Accordingly, the problem that a conductive member in the periphery of contacts is extraordinarily heated and melted, which hastens damage or causes a short circuit is solved, and the reliability of an appliance is improved.

Figure 2:
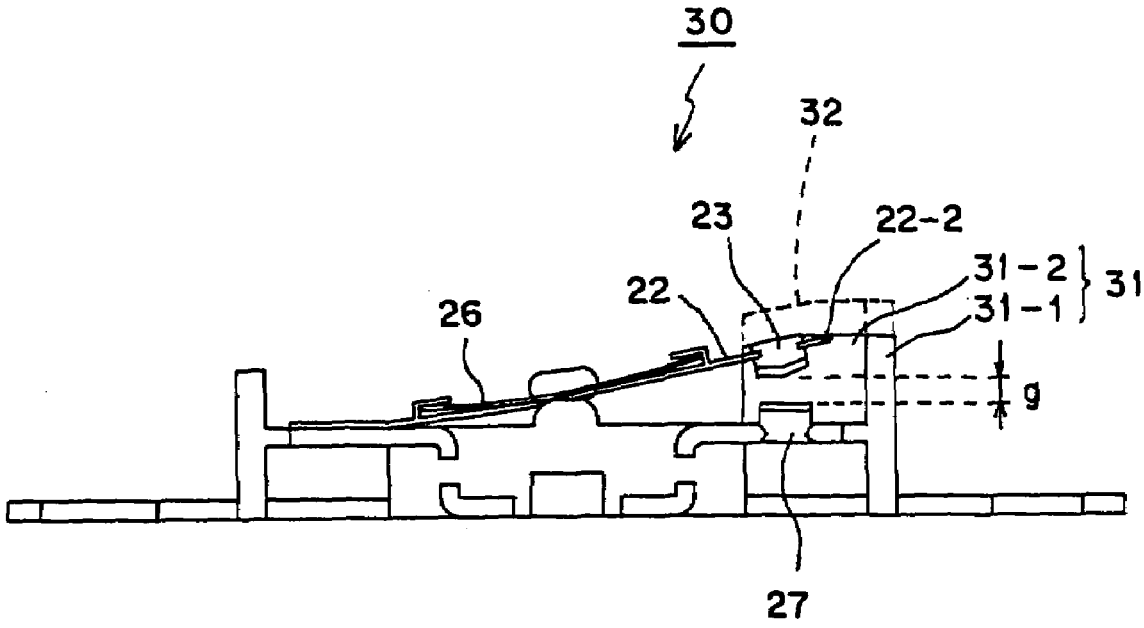
FIG. 2 is a sectional side view showing a modification example of the thermal protector according to the first preferred embodiment.

FIG. 2 is a sectional side view showing a modification example of the thermal protector according to the first preferred embodiment. In the configuration shown in this figure, constituent elements except for the configuration of a partition wall are similar to those of the thermal protector 15 shown in FIG. 1. Therefore, only constituent elements required for explanation are denoted with reference numerals and shown.

As shown in this figure, the thermal protector 30 in this modification example represents the state where contacts are released when an electric current is interrupted in a similar manner as in FIG. 1(*c*), and, in contrast to the fixed contact 27, the movable contact 23 is positioned in an uppermost location of its displacement. A gap between the contacts is similar to the gap g shown in FIG. 1. In the meantime, for a partition wall 31 (a partition wall 31-1 in the central portion of three sides, and partition walls 31-2 on two sides), not only the partition wall 31-1 in the central portion of the three sides, but also the partition walls 31-1 and 31-2 on the two sides are configured to be higher than the gap g between the contacts, and to have a height which does not exceed the height of the other end 22-2 of the movable plate 22 when the contacts are released (namely, the partition walls may have an equal height).

As described above, if not only the partition wall 31-1 in the central portion of the three sides but also the partition walls 31-2 on the two sides are configured to enclose the movable contact 23 and the other end 22-2 of the movable plate 22, it becomes more and more difficult that a wind flows between the contacts. Accordingly, an appliance exposed to a higher wind velocity can be supported.

Note that, however, a higher partition wall is not always good to prevent a wind from directly flowing between the contacts. For example, if the partition wall is formed to be too high and exceeds the movable contact 23 and the other end 22-2 of the movable plate 22 as indicated by a broken line 32 in FIG. 2, an action for confining an arc which occurs between the contacts within the narrow space of the partition wall 32 works too hard, the arc and its periphery are made hot, and even the end 22-2 of the movable plate and the tip of the bimetal 26 are melted by the arc.

Accordingly, as described above, although the partition wall 31 must be set to be higher than the gap g when the contacts are released, it must have a height which does not exceed the heights of the movable contact 23, and the end 22-2 of the movable plate 22.

According to both of the above described preferred embodiment and its modification example, the partition wall is arranged by imposing a limitation to enclose only a contact portion. However, the present invention is not limited to this configuration. The partition wall may be formed to enclose the whole of the main body of the thermal protector except for the external circuit connection terminals 17 and 18. This configuration is explained below as the second preferred embodiment.

Figure 3:
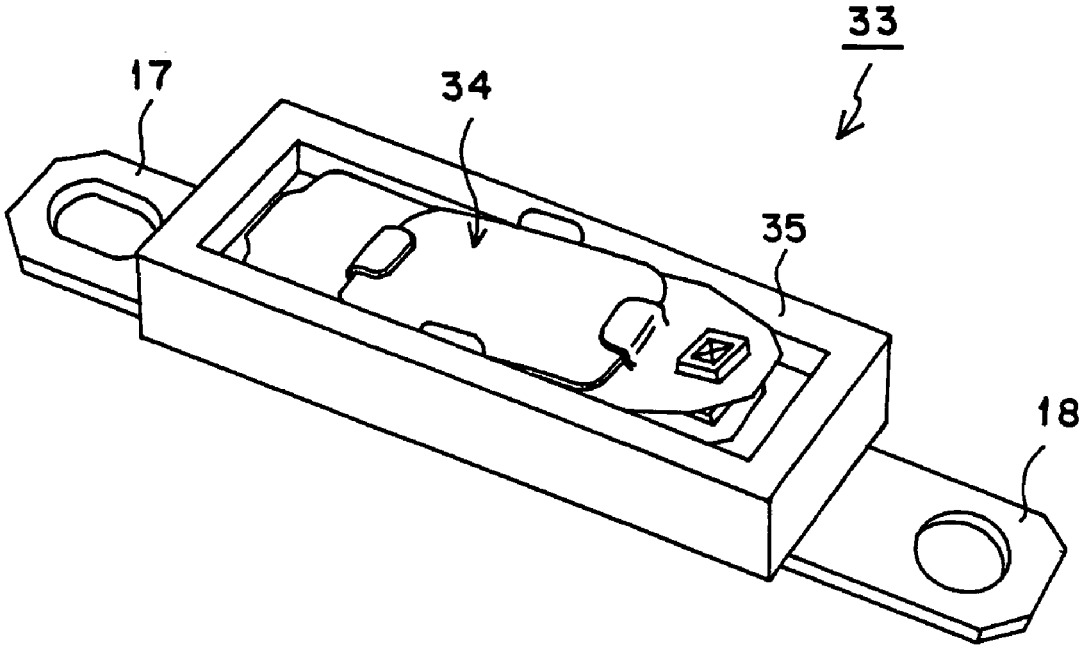
FIG. 3 is a perspective view of a thermal protector according to a second preferred embodiment.

FIG. 3 is a perspective view of the thermal protector according to the second preferred embodiment. Also in this figure, configurations of constituent elements other than a partition wall are similar to those of the thermal protector 15 shown in FIG. 1. Therefore, only constituent elements required for explanation are denoted with reference numerals and shown in FIG. 3.

As shown in FIG. 3, in this thermal protector 22, a partition wall 35 is formed to enclose the whole of the main body 34 of the thermal protector except for external circuit connection terminals 17 and 18. Also in this case, the height of the partition wall 35 is formed to be higher than a gap g (see FIG. 1(*c*) or 2) when contacts are released, and to have a height which does not exceed the heights of the movable contact 23 and the end 22-2 of the movable plate 22.

As described above, by forming the whole of the main body 34 of the thermal protector except for the external circuit connection terminals 17 and 18 to be enclosed by the partition wall 35, a configuration where a wind is difficult to directly flow between the contacts in any direction is implemented. Therefore, even if the thermal protector 33 within an appliance is arranged in an orientation oblique or orthogonal to the direction of a wind velocity, effects of preventing a problem that an arc between released contacts when a high electric current is interrupted is carried away by a high wind velocity, and damages a conductive member in the periphery of the contacts is maintained. Accordingly, the degree of freedom of designing an appliance where the thermal protector is arranged inside can be enhanced, which offers a convenience.

As described above in detail, according to the present invention, a partition wall having a height in a range which does not confine an arc excessively is arranged at least in the neighborhood of contacts in a thermal protector as a temperature over-rise preventing device included in recent hair dryer, electronic fan heater, popcorn machine, etc., which use a high electric current. Accordingly, an arc between the contacts can be prevented from coming out of the contacts by being carried way by a wind, and from being spattered to a conductive member in the neighborhood of the contacts even when a high electric current is interrupted, or in a wind of a high rate of flow.

As a result, the problem that a conductive member in the periphery of contacts is extraordinarily heated and melted by a spattering arc, which hastens damage or causes a short circuit can be solved, whereby effects that the reliability of an appliance is improved can be obtained.

Furthermore, the whole of the main body of the thermal protector is enclosed by a partition wall, so that a configuration where a wind is difficult to directly flow between contacts in any direction is implemented. Therefore, even if the thermal protector within an appliance is arranged in an orientation oblique or orthogonal to the direction of a wind velocity, effects of preventing an arc between released contacts when a high electric current is interrupted from being carried away by a high wind velocity, and from damaging a conductive member in the periphery of the contacts is maintained. Accordingly, the degree of freedom of designing an appliance where the thermal protector is arranged inside is enhanced, which offers a convenience.

Industrial Applicability

As described above, if the thermal protector according to the present invention is arranged in a desired position in an appliance that uses a high electric current or a wind of a high rate of flow, no problems are caused by the melting, the damage, the short circuit, etc. of a conductive member, and the reliability of the appliance is high. Therefore, the present invention is applicable to all of industries using a hot-air generating device, such as a hair dryer, an electronic fan heater, a popcorn machine, etc., which utilize a high electric current or a wind of a high rate of flow, and require high reliability.

The invention claimed is:

1. A thermal protector opening/closing an electric circuit with a bimetal which inverts a warpage direction by using a set temperature as a boundary, comprising:

a fixed contact connected to a first external circuit connection terminal;

a movable contact arranged at a first end of a movable plate which is engaged with the bimetal and connected to a second external circuit connection terminal, said movable contact being arranged in a position corresponding to said fixed contact; and a partition wall enclosing an arrangement portion of said fixed contact and said movable contact from three sides, being adjacent to said fixed contact and said movable contact in a range which does not inhibit contact operations of said fixed contact and said movable contact;

wherein a central portion among the three sides of said partition wall is higher than a contact gap between said fixed contact and said movable contact when said contacts are released, and does not exceed a height of the first end of the movable plate when said contacts are released.

2. The thermal protector according to claim 1, wherein a second end of the movable plate is secured and connected to said second external circuit connection terminal, and the partition wall is formed to be higher than at least a height of said fixed contact.

3. The thermal protector according to claim 1, wherein said partition wall is arranged to enclose a periphery of the movable plate.

4. The thermal protector according to claim 1, wherein said partition wall is made of an insulating material.

5. The thermal protector according to claim 1, wherein said partition wall is incorporated into one body with the first and second external circuit connection terminals.

* * * * *